US006461802B1

(12) United States Patent
Van Thillo et al.

(10) Patent No.: US 6,461,802 B1
(45) Date of Patent: Oct. 8, 2002

(54) ADHESIVE LAYER FOR POLYESTER FILM

(75) Inventors: Etienne Van Thillo, Essen (BE); Patrick Mertens, Vrasene (BE); Jozef Boeykens, Mortsel (BE); Filip Vandaele, Gentbrugge (BE)

(73) Assignee: Agfa-Gevaert

( * ) Notice: Subject to any disclaimer, the term of this patent is extended or adjusted under 35 U.S.C. 154(b) by 6 days.

(21) Appl. No.: 09/629,710

(22) Filed: Jul. 31, 2000

Related U.S. Application Data

(60) Provisional application No. 60/150,936, filed on Aug. 26, 1999.

(51) Int. Cl.[7] ..... G03C 1/725; G03C 1/73; G03C 1/735; G03C 5/00

(52) U.S. Cl. ..... 430/336; 430/332; 430/334; 430/338; 428/480; 524/366; 524/378

(58) Field of Search ..... 428/46, 47, 55, 428/412, 421, 423.7, 480, 482, 483, 500, 355 R, 355 EN; 500/401, 425; 523/136; 524/366, 378; 430/332, 334, 336, 338

(56) References Cited

U.S. PATENT DOCUMENTS

| | | | | | |
|---|---|---|---|---|---|
| 4,203,769 | A | * | 5/1980 | Guestaux | 430/631 |
| 4,959,468 | A | * | 9/1990 | Ravi et al. | 536/127 |
| 5,292,628 | A | * | 3/1994 | Nittel et al. | 430/539 |
| 5,358,831 | A | | 10/1994 | Bagchi et al. | 430/449 |
| 5,441,770 | A | * | 8/1995 | Rychwalski et al. | 427/306 |
| 5,523,335 | A | * | 6/1996 | Whyzmuzis et al. | 523/160 |

FOREIGN PATENT DOCUMENTS

| | | |
|---|---|---|
| EP | 0549496 | 6/1993 |

* cited by examiner

*Primary Examiner*—James J. Seidleck
*Assistant Examiner*—Travis B. Ribar
(74) *Attorney, Agent, or Firm*—Joseph T. Guy; Nexsen Pruet Jacobs & Pollard, LLC

(57) ABSTRACT

The coating quality of an adhesive layer applied in direct contact on a polyester film is improved by using an alkyl (poly)glycoside as surfactant. A polyester film carrying such layer is suitable as support for a photosensitive material.

2 Claims, No Drawings

ADHESIVE LAYER FOR POLYESTER FILM

The application claims the benefit of the U.S. Provisional Application No. 60/150,936 filed Aug. 26, 1999.

FIELD OF THE INVENTION

The present invention relates to a polyester film carrying in direct contact an adhesive layer and the use of such a film as support for photosensitive materials, e.g. photographic materials.

BACKGROUND OF THE INVENTION

In order to ensure a perfect adhesion of hydrophilic layers such as photographic light-sensitive emulsion layers to dimensionally stable polyester film supports, i.e. polyester films that have been biaxially stretched and heat-setted, it is known for long time to apply several intermediate layers between the support and the light-sensitive emulsion layer (s). In most cases two intermediate layers are needed. A first one, known as the adhesive layer or primer layer or resin subbing layer or latex subbing layer, shows a good adhesion to the polyester film and at the same time possesses good attaching properties in respect to the second layer, known as the subbing layer or gelatin subbing layer or gelatin sublayer, which usually is formed to a great extent of a hydrophilic colloid such as gelatin. For sake of uniformity we will further refer to the first intermediate layer defined above as the adhesive layer.

A preferred polyester film for use as support for imaging elements such as photographic materials is polyethylene terephthalate (PET). This and other polyester film supports are preferably biaxially stretched at an elevated temperature of e.g. 70–120° C., reducing their thickness by about ⅙ to 1/16 or more and increasing its area 9 to 16 times. The stretching may be accomplished in two stages, longitudinal and then transversal, or simultaneously. The adhesive layer, when present, may be applied by aqueous coating before or after the biaxial stretch or between the longitudinal and transversal stretch, in a thickness of 0.05 to 5 $\mu$m. An essential ingredient of this layer is an adhesion-promoting (co)polymer. In some preferred embodiments, disclosed e.g. in GB 1 234 755, GB 2 068 004 and EP 0 464 906, this (co)polymer contains as one of its structural units a monomer comprising covalently bound chlorine. Examples of said homopolymers or copolymers suitable for use in the adhesive layer are e.g. polyvinyl chloride; polyvinylidene chloride; a copolymer of vinylidene chloride, an acrylic ester and itaconic acid; a copolymer of vinyl chloride and vinylidene chloride; a copolymer of vinyl chloride and vinyl acetate; a copolymer of butylacrylate, vinyl acetate and vinyl chloride or vinylidene chloride; a copolymer of vinyl chloride, vinylidene chloride and itaconic acid; a copolymer of vinyl chloride, vinyl acetate and vinyl alcohol etc. Further patents disclosing such (co)polymers include U.S. Pat. Nos. 2,627,088, 2,698,235, 2,698,240, 2,943,937, 3,143,421, 3,201,249, 3,271,178, 3,443,950 and 3,501,301.

The adhesive layer is preferably coated from an aqueous medium which is ecologically and economically advantageous. Relatively little is published about the surfactants, also called coating aids or wetting agents, used in the coating solution of the adhesive layer. In the examples of GB 1 533 555 and GB 1 571 583 ULTRAVON W is disclosed as surfactant for the coating solution of the adhesive layer. ULTRAVON W, registered trade mark of Ciba-Geigy, is the disodium salt of heptadecylbenzimidazole disulphonic acid.

Depending on the actual composition there is a some cases a tendency to the formation of repellency spots in the coated and dried adhesive layer when ULTRAVON W is used as surfactant. A repellency is a round, or comet-shaped indentation or crater, or a vestige of such a disturbance which has partially healed after formation. Imperfections of this kind are formed during the coating process or shortly thereafter when the coating composition is still fluid and mobile. When subsequent layers such as the gelatin subbing layer and the photosensitive layer are coated on top of the adhesive layer this imperfection can propagate in these other layers and become visible in the final developed image.

So there is a permanent need for new classes of surfactants which overcome or strongly reduce the tendency to the formation of repellencies in the adhesive layer.

OBJECTS OF THE INVENTION

It is an object of the present invention to provide a polyester film carrying in immediate contact an adhesive layer showing none or a very limited number of repellency spots.

It is a further object of the invention to provide imaging elements, in particular photosensitive elements, which use such an improved polyester film as support.

SUMMARY OF THE INVENTION

The objects of the present invention are realized by providing a polyester film carrying in direct contact an adhesive layer comprising an alkyl (poly)glycoside surfactant according to following formula (I):

$$C_nH_{2n+1}—O—(C_6H_{10}O_5)_x—H, \quad (I),$$

wherein $C_6H_{10}O_5$ represents a monosaccharide unit, n=5 to 20, x represents an integer or fractal mean value between 1 and 4.

An imaging element, in particular a radiation-sensitive element such as a photographic element, using a polyester film as defined above also belongs to the scope of the present invention.

DETAILED DESCRIPTION OF THE INVENTION

The polyester film supports which can be advantageously employed in this invention are well known and widely used materials. Such film supports are typically prepared from higher molecular weight polyesters derived by condensing dihydric alcohol with a dibasic saturated fatty carboxylic acid or derivative thereof. Suitable dihydric alcohols for use in preparing polyesters are well known in the art to include any glycol wherein the hydroxy groups are on the terminal carbon atom and that contains from 2 to 12 carbon atoms such as, for example, ethylene glycol, propylene glycol, trimethylene glycol, hexamethylene glycol, decamethylene glycol, dodecamethylene glycol, and 1,4-cyclohexane dimethanol. Dibasic acids that can be employed in preparing polyesters include those dibasic acids containing from 1 to 16 carbon atoms. Specific examples of suitable dibasic acids include adipic acid, sebacic acid, isophtalic acid and terephthalic acid. The alkyl esters of the above-enumerated acids can also be used satisfactorily.

Specific preferred examples of polyester resins, which may be used in the form of webs or sheets are polyethylene terephthalate (PET), poly(cyclohexane 1,4-dimethylene terephthalate), and poly(ethylene naphtalate). The most preferred example is PET.

The thickness of the polyester film is not critical and depends on the application. For instance, polyester film of a thickness ranging between 0.05 to about 0.25 mm can be used with satisfactory results.

In a typical process for the manufacture of a polyester photographic film support, the polyester is melt extruded through a slit die, quenched to the amorphous state, oriented by longitudinal and transverse stretching, and heat set under dimensional restraint. In addition to being directionally oriented and heat set, the polyester film can also be subjected to a subsequent heat relax treatment to provide still further improvement in dimensional stability and surface smoothness.

The adhesive layer or latex subbing layer can be coated on top of the finished polyester film before or after the biaxial stretching or between the longitudinal and transverse stretching. It is the essence of the present invention that the coating solution from the adhesive layer contains, apart from the latex (co)polymer an alkyl-(poly)glycoside as surfactant.

The history, the synthesis of alkyl (poly)glycosides (APG's), and their industrial application as surfactants are extensively reviewed by W. von Rybinski and K. Hill in *Angewandte Chemie* (1998) Vol 110, p. 1394–1412.

The first alkyl glucoside was synthesized and identified by E. Fisher more than 100 years ago. In later developments, Fisher's early work which was concerned with the lower hydrophilic alcohols was extended to hydrophobic alcohols with longer alkyl chains, the typical fatty alcohols. In these industrial processes not pure alkyl monoglucosides but a complex mixture of alkyl mono-, di-, tri-, and oligoglycosides is produced. Because of this, the industrial products are called alkyl polyglycosides (APG). The products are characterized by the length of the alkyl chain, and the average number of the monosaccharide units, mostly glucose units, linked to it, the degree of polymerization. It will be clear that this average number (x in general formula I) will be a fractal number in most cases.

APG's are now offered on an industrial scale by different manufacturers such as Rohm & Haas, BASF, SEPPIC, Akzo Nobel, Procter & Gamble and Henkel.

It is to our knowledge the first time that APG's are described as surfactants for the adhesive layer coated directly onto a polyester film, such as polyethylene terephthalate, which is a widely used support in the manufacturing of photographic materials. Such adhesive layers are usually free of gelatin and comprise an adhesive promoting (co)polymer as explained above. APG's have been disclosed in hydrophilic, gelatin containing photographic layers. They have been described in U.S. Pat. No. 5,358,831 and U.S. Pat. No. 5,591,568 as viscosity decreasing and rheology controlling agents in photographic layers containing gelatin and small-particles dispersions. In U.S. Pat. No. 5,300,418 APG's are one of numerous amphiphilic species capable of reducing the viscosity of melts comprising gelatin and an anionically charged, hydrophobic group containing compound. According to EP 0 549 496 long chain APG's are used together with an auxiliary anionic or nonionic surfactant to improve the thickness uniformity of gelatinous layers.

The APG surfactants used in accordance with the present invention are added to the coating solution of the adhesive layer in a preferred concentration range between 1 and 10 mmol/l, and most preferably in a concentration of about 5 mmol/l.

As explained earlier another essential ingredient of the coating composition of the adhesive layer is the adhesion-promoting latex (co)polymer. A preferred class of latex polymers for the purposes of this invention are vinylidene chloride-containing copolymers having carboxyl functional groups. Illustrative of such polymers are (1) copolymers of vinylidene chloride and an unsaturated carboxylic acid such as acrylic or methacrylic acid, (2) copolymers of vinylidene chloride and a half ester of an unsaturated carboxylic acid such as the monomethylester of itaconic acid, (3) terpolymers of vinylidene chloride, itaconic acid and an alkyl acrylate or methacrylate such as ethyl acrylate or methyl methacrylate, and (4) terpolymers of vinylidene chloride, acrylonitrile or methacrylonitrile and an unsaturated carboxylic acid such as acrylic acid or methacrylic acid.

In a most preferred embodiment the latex polymer is co(vinylidene chloride-methyl acrylate-itaconic acid; 88%/10%/2%). This copolymer is prepared by emulsion polymerization using 0.5% MERSOLAT H (trade-mark of Bayer AG) as emulsifying agent. It is necessary to add extra surfactant, a so-called post-stabilizer, to the latex in order to assure a good stability on storage. An excellent storage stability is obtained when 1% of DOWFAX 2A1 (tradename of Dow Co.) is added to the actual latex described above. When a coating composition based on such a post-stabilized latex is coated on PET a lot of repellencies are obtained when no surfactant or a conventional surfactant is added. This problem is solved in the present invention by the use of an APG as surfactant.

As a further preferred ingredient of the coating solution of the latex subbing layer colloidal silica may be added as a binder. A preferred compound is KIESELSOL 100F (trademark of Bayer AG), average particle size 25–30 nm. The ratio of the amount of latex to silica is preferably about 80/20.

The adhesive layer may be coated on top of the polyester film using one of the well known coating techniques. Air-knife coating technique is preferred.

When the polyester film of the present invention is meant to serve as support for a photosensitive material usually a second intermediate layer is applied on top of the first adhesive layer, namely the gelatin subbing layer or "gel sub".

The gelatin subbing layer preferably contains a mixture of gelatin and colloidal silica. A preferred compound is KIESELSOL 300F (trade-mark of Bayer AG) having an average particle size between 0.1 $\mu$m and 0.5 $\mu$m. A plasticizing compound can be used in order to avoid the formation of cracks in the dried layer due to the occurence of excessive shrinking of the layer during drying. Plasticizing agents are well-known in the art. Low-molecular weight compounds (e.g. acetamide, glycerin) as well as polymeric latices (e.g. polyethylacrylate, poly-n.-butylacrylate) can be used for this purpose.

When the photosensitive material is a silver halide based photographic layer then one or more emulsion layers and a protective layer are coated on top of the subbing layer(s).

The silver halide emulsion or mixture of emulsions of the photographic material in connection with the present invention can be incorporated in one single layer but, alternatively, a double emulsion layer or even a multiple layer pack can be applied.

The halide composition of the silver halide emulsions used in accordance with the present invention is not specifically limited and may be any composition selected from e.g. silver chloride, silver bromide, silver iodide, silver chlorobromide, silver bromoiodide, and silver chlorobromoiodide.

The photographic emulsion(s) can be prepared from soluble silver salts and soluble halides according to different methods as described e.g. by P. Glafkides in "Chimie et Physique Photographique", Paul Montel, Paris (1967), by G. F. Duffin in "Photographic Emulsion Chemistry", The Focal Press, London (1966), and by V. L. Zelikman et al in "Making and Coating Photographic Emulsion", The Focal Press, London (1966). They can be prepared by mixing the halide and silver solutions in partially or fully controlled conditions of temperature, concentrations, sequence of addition, and rates of addition. The silver halide can be precipitated according to the single-jet method, the double-jet method, the conversion method or an alternation of these different methods.

The silver halide particles of the photographic emulsion(s) may have a regular crystalline form such as a cubic or octahedral form or they may have a transition form. They may also have an regular crystalline form such as a spherical form or a tabular form, or may otherwise have a composite crystal form comprising a mixture or said regular and irregular crystalline forms.

The silver halide grains may have a multilayered grain structure. According to a simple embodiment the grains may comprise a core and a shell, which may have different halide compositions and/or may have undergone different modifications such as the addition of dopes. Besides having a differently composed core and shell the silver halide grains may also comprise different phases inbetween.

Two or more types of silver halide emulsions that have been prepared differently can be mixed for forming a photographic emulsion for use in accordance with the present invention.

The average size of the silver halide grains may range from 0.05 to 1.0 micron, preferably from 0.2 to 0.5 micron. The size distribution of the silver halide particles can be homodisperse or heterodisperse.

The silver halide emulsions can be doped with various metal salts or complexes such as Rhodium and Iridium dopants.

The emulsion can be desalted in the usual ways e.g. by dialysis, by flocculation and re-dispersing, or by ultrafiltration.

The light-sensitive silver halide emulsions are preferably chemically sensitized as described e.g. in the above-mentioned "Chimie et Physique Photographique" by P. Glafkides, in the above-mentioned "Photographic Emulsion Chemistry" by G. F. Duffin, in the above-mentioned "Making and Coating Photographic Emulsion" by V. L. Zelikman et al, and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners, gold-selenium ripeners or by means of reductors e.g. tin compounds as described in GB 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The light-sensitive silver halide emulsions can be spectrally sensitized with proper dyes such as those described by F. M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, hemicyanine dyes, styryl dyes and hemioxonol dyes. Particularly valuable dyes are those belonging to the cyanine dyes, merocyanine dyes and complex merocyanine dyes.

The silver halide emulsion(s) for use in accordance with the present invention may comprise compounds preventing the formation of fog or stabilizing the photographic characteristics during the production or storage of photographic elements or during photographic treatment thereof. Many known compounds can be added as fog-inhibiting agent or stabilizer to the silver halide emulsion. Suitable examples are e.g. the heterocyclic nitrogen-containing compounds such as benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles, mercaptopyrimidines, mercaptotriazines, benzothiazoline-2-thione, oxazoline-thione, triazaindenes, tetraindenes and pentazaindenes, especially those described by Birr in *Z. Wiss. Photo.* 47 (1952), pages 2–58, triazolopyrimidines such as those described in GB 1,203,757, GB 1,209,146, JA-Appl. 75–39537, and GB 1,500,278, and 7-hydroxy-s-triazolo-[1, 5-a]-pyrimidines as described in U.S. Pat. No. 4,727,017, and other compounds such as benzenethiosulphonic acid, benzenethosulphinic acid and benzenethiosulphonic acid amide. Other compounds that can be used as fog-inhibiting compounds are metal salts such as e.g. mercury or cadmium salts and the compounds described in *Research Disclosure* N° 17643 (1978), Chapter VI.

The fog-inhibiting agents or stabilizers can be added to the silver halide emulsions prior to, during, or after the ripening thereof and mixtures of two or more of these compounds can be used.

Besides the silver halide another essential component of a light-sensitive emulsion layer is the binder. The binder is a hydrophilic colloid, preferably gelatin. Gelatin can, however, be replaced in part or integrally by synthetic, semi-synthetic, or natural polymers. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Other suitable surfactants include perfluorinated compounds. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Beside the light sensitive emulsion layer(s) the photographic material can contain several non light sensitive layers, e.g. an anti-stress top layer, one or more backing layers, and one or more intermediate layers eventually containing filter- or antihalation dyes that absorb scattering light and thus promote the image sharpness. Suitable light-absorbing dyes are described in i.a. U.S. Pat. No. 4,092,168, U.S. Pat. No. 4,311,787 and DE 2,453,217. One or more backing layers can be provided at the non-light sensitive side of the support. This layers which can serve as anti-curl layer can contain i.a. matting agents e.g. silica particles, lubricants, antistatic agents, light absorbing dyes, opacifying agents, e.g. titanium oxide and the usual ingredients like hardeners and wetting agents.

The backing layer(s) may further contain an antistatic agent. Suitable antistatic polymers for incorporation in a backing layer are disclosed in e.g. Research Disclosure, April 1990, Item 31237. Further references on ionic conductive polymers include U.S. Pat. No. 4,585,730, U.S. Pat. No. 4,701,403, U.S. Pat. No. 4,589, 570, U.S. Pat. No. 5,045,441, EP-A-391 402 and EP-A-420 226. An antistatic agent can also be incorporated in a separate layer or in a subbing layer. Relatively recently electrically conducting conjugated polymers have been developed that have electronic conductivity. For ecological reasons the coating of antistatic layers should proceed where possible from aqueous solutions by using as few as possible organic solvents. The production of antistatic coatings from aqueous coating compositions being dispersions of polythiophenes in the presence of polyanions is described in EP 0 440 957.

The photographic elements in connection with the present invention may further comprise various other additives such as e.g. compounds improving the dimensional stability of the photographic element, UV-absorbers, spacing agents and plasticizers.

Suitable additives for improving the dimensional stability of the photographic elements are e.g. dispersions of a water-soluble or hardly soluble synthetic polymer e.g. polymers of alkyl(meth)acrylates, alkoxy(meth)acrylates, glycidyl(meth)acrylates, (meth)acrylamides, vinyl esters, acrylonitriles, olefins, and styrenes, or copolymers of the above with acrylic acids, methacrylic acids, α-β-unsaturated dicarboxylic acids, hydroxyalkyl(meth)acrylates, sulphoalkyl-(meth)acrylates, and styrene sulphonic acids.

Spacing agents can be present, preferably in the top protective layer. In general the average particle size of such spacing agents is comprised between 0.2 and 10 micron. They can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made e.g. of poly(methylmethacrylate), of copolymers of acrylic acid and methylmethacrylate, and of hydroxypropylmethyl cellulose hexahydrophthalate. Other suitable spacing agents have been described in U.S. Pat. No. 4,614,708.

The photographic material is exposed and processed according to its particular composition and application.

The following examples will illustrate the present invention without however being limited thereto.

EXAMPLE

The coating solutions for the adhesive layer samples were composed of two main ingredients, in a 80%/20% ratio by weight:

copolymer latex vinylidene chloride/methylacrylate/itaconic acid: 88/10/2;

KIESELSOL 100F (Bayer AG).

To the solutions a dispersion of the blue dye FLEXONYL-BLAU B2G-LA was added for easier identification and counting of the repellencies in the coated samples.

The APG surfactants according to the invention (see table 1 and 2) were added in a concentration of 4.8 mmol/l. As comparison compounds Aerosol TO, Triton X-200, and the perfluorinated surfactants Zonyl FSN and FT 248 were used. In the case of FT 248 ammonia was added to pH 8 in order to prevent flocculation.

The solutions were coated on biaxially stretched PET having a thickness of 100 μm and a width of 24 cm. They were coated at a coverage of 130 $m^2$/l corresponding to a wet layer thickness of 7.7 μm. They were coated by air-knife at a speed of 100 m/min.

The number repellencies were counted after the coating of 25–35, 75–85, and 300–310 meter respectively. They are expressed per 10 running meter of polyester web. The identification of the surfactants and the results of the counting are summarized in tables 1 and 2.

TABLE 1

| surfactant No | commercial name | manufacturer |
|---|---|---|
| Inv-A | Glucopon 600EC | Henkel |
| Inv-B | Atlas AL 2575 P | ICI |
| Inv-C | Atlas AL 2559 | ICI |
| Inv-D | Plantacare 2000UP | Henkel |
| Inv-E | Glucopon 225 DK | Henkel |
| Inv-F | Glucopon 215 CSUP | Henkel |
| Inv-G | Simulsol SL-8 | Sepic |
| Inv-H | Triton BG-10 | Union Carbide |
| Comp-1 | Aerosol OT | American Cyanamide |
| Comp-2 | Triton X-200 | Union Carbide |
| Comp-3 | Zonyl FSA | DuPont |
| Comp-4 | FT 248 | Bayer |

TABLE 2

| | Number of repellencies | | | | |
|---|---|---|---|---|---|
| Surf. | 25–35 m | 75–85 m | 300–310 m | total | mN/m* |
| none | 20 | 19 | 8 | 47 | 50 |
| Inv-A | 0 | 0 | 0 | 0 | 35 |
| Inv-B | 0 | 0 | 0 | 0 | 38 |
| Inv-C | 0 | 0 | 1 | 1 | 37 |
| Inv-D | 1 | 1 | 0 | 2 | 36 |
| Inv-E | 1 | 1 | 0 | 2 | 38 |
| Inv-F | 3 | 0 | 0 | 3 | 38 |
| Inv-G | 1 | 2 | 0 | 3 | 39 |
| Inv-H | 2 | 1 | 4 | 7 | 38 |
| Comp-1 | 9 | 4 | 5 | 18 | 19 |
| Comp-2 | 10 | 7 | 6 | 23 | 46 |
| Comp-3 | >50 | >50 | >50 | >150 | 19 |
| Comp-4 | 4 | 5 | 1 | 10 | 29 |

*surface tension of the coating solution

It is clear from table 2 that the invention compounds reduce more effectively the number of repellencies than the comparison compounds. A remarkable and unexpected phenomenon is the fact that the fluor containing comparison surfactants give a worse result although they decrease far more strongly the surface tension of the coating solution that the APG compounds do.

What is claimed is:

1. An imaging element comprising an imaging layer and as a support a polyester film carrying in direct contact an adhesive layer comprising an alkyl glycoside or alkyl polyglycoside surfactant according to following formula (I):

$$C_nH_{2n+1}—O—(C_6H_{10}O_5)_x—H, \quad (I),$$

wherein $C_6H_{10}O_5$ represents a monosaccharide unit, n=5 to 20, and x represents an integer or a fractal mean value between 1 and 4; and wherein said imaging layer is a radiation sensitive layer.

2. An imaging element according to claim 1 wherein said radiation sensitive layer is a silver halide based photographic layer.

* * * * *

UNITED STATES PATENT AND TRADEMARK OFFICE

CERTIFICATE OF CORRECTION

PATENT NO. : 6,461,802 B1
DATED : October 8, 2002
INVENTOR(S) : Van Thillo et al.

It is certified that error appears in the above-identified patent and that said Letters Patent is hereby corrected as shown below:

Title page,
Insert:

-- [30] Foreign Application Priority Data
Aug. 2, 1999 [EP] 99202519 --

Signed and Sealed this

Sixth Day of May, 2003

JAMES E. ROGAN
*Director of the United States Patent and Trademark Office*